US010654699B2

(12) United States Patent
Kim

(10) Patent No.: US 10,654,699 B2
(45) Date of Patent: May 19, 2020

(54) WATER DISPENSER

(71) Applicant: LG ELECTRONICS INC., Seoul (KR)

(72) Inventor: Seulki Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/297,191

(22) Filed: Mar. 8, 2019

(65) Prior Publication Data

US 2019/0202679 A1 Jul. 4, 2019

Related U.S. Application Data

(63) Continuation of application No. 15/238,030, filed on Aug. 16, 2016, now Pat. No. 10,266,381.

(30) Foreign Application Priority Data

Aug. 21, 2015 (KR) ..... 10-2015-0118212

(51) Int. Cl.
*B67D 1/00* (2006.01)
*B67D 1/08* (2006.01)

(52) U.S. Cl.
CPC ..... *B67D 1/0004* (2013.01); *B67D 1/0081* (2013.01); *B67D 1/0864* (2013.01); *B67D 1/0888* (2013.01); *B67D 1/0895* (2013.01); *B67D 2210/00031* (2013.01); *B67D 2210/00039* (2013.01); *B67D 2210/00044* (2013.01); *B67D 2210/00118* (2013.01)

(58) Field of Classification Search
CPC .. B67D 1/0888; B67D 1/0895; B67D 1/0081; B67D 1/0004; B67D 1/0864; F25D 19/006; F25D 31/002; F25D 11/002; F25D 23/00; F28D 11/0472; F28D 7/02; F28F 13/125; F28F 2250/08; F25B 39/02
USPC ..... 222/146.6
See application file for complete search history.

(56) References Cited

U.S. PATENT DOCUMENTS 3,169,690 A 2/1965 Scholle
4,008,832 A 2/1977 Rodth
(Continued)

FOREIGN PATENT DOCUMENTS

CN 200994716 12/2007
CN 201476463 5/2010
(Continued)

OTHER PUBLICATIONS

English Translation of KR20110065979, worldwide.espacenet.com, Jun. 17, 2019.*
(Continued)

*Primary Examiner* — Vishal Pancholi
*Assistant Examiner* — Robert K Nichols, II
(74) *Attorney, Agent, or Firm* — KED & Associates, LLP

(57) ABSTRACT

A liquid dispenser is provided. The liquid dispenser may include a water tank to store water, a cooling module provided in the water tank to circulate cooling water to cool the water to make cold water, a drain valve that connects to the water tank and protrudes from the water tank to discharge the cooling water in the water tank, and a foam insulator that covers an outer circumferential surface of the water tank and contacts the drain valve to prevent the drain valve from being exposed to air.

11 Claims, 9 Drawing Sheets

(56) References Cited

U.S. PATENT DOCUMENTS

| | | | | | |
|---|---|---|---|---|---|
| 4,129,145 | A | | 12/1978 | Wynn | |
| 4,916,910 | A | * | 4/1990 | Schroeder | B67D 1/0864 62/390 |
| 5,390,826 | A | | 2/1995 | Burrows | |
| 5,617,736 | A | * | 4/1997 | Ito | B67D 1/0864 222/146.6 |
| 5,797,519 | A | * | 8/1998 | Schroeder | B67D 1/0032 222/129.1 |
| 5,927,557 | A | | 7/1999 | Busick | |
| 8,448,564 | B2 | | 5/2013 | Hart | |
| 8,833,090 | B2 | * | 9/2014 | Breton-Hall | F25D 31/003 62/233 |
| 2003/0217564 | A1 | * | 11/2003 | Jones | B67D 1/0015 62/390 |

FOREIGN PATENT DOCUMENTS

| | | | |
|---|---|---|---|
| CN | 202457928 | | 10/2012 |
| JP | 2003-192097 | | 7/2003 |
| KR | 2003-039779 | | 1/2004 |
| KR | 20110065979 | A * | 6/2011 |
| KR | 2013-0006021 | | 1/2013 |
| KR | 10-1296434 | | 8/2013 |

OTHER PUBLICATIONS

Korean Office Action dated Aug. 5, 2016 issued in Application No. 10-2015-0118212.
Chinese Office Action dated Jul. 23, 2018 issued in Application No. 201610694133.2 (English translation attached).
U.S. Office Action dated Oct. 11, 2017 issued in U.S. Appl. No. 15/238,030.

* cited by examiner

WATER DISPENSER

CROSS-REFERENCE TO RELATED APPLICATION

This application is a Continuation Application of prior U.S. patent application Ser. No. 15/238,030 filed Aug. 16, 2016, which claims priority under 35 U.S.C. § 119 to Korean Application No. 10-2015-0118212, filed on Aug. 21, 2015, whose entire disclosure is incorporated herein by reference.

BACKGROUND

1. Field

Embodiments relate to a water dispenser.

2. Background

A water dispenser may be a device that filters foreign objects contained in water via physical and/or chemical processes to make filtered or purified water. Ionizers or water softeners may be broadly classified as water dispensers. Some water dispensers provide both hot water and cold water. A water dispenser that provides both hot water and cold water may include a heating device and a cooling device. The heating device may be configured to heat water or purified water so as to provide hot water to a user, and the cooling device may be configured to cool water or purified water so as to provide cold water to a user. In order to produce cold water, cooling water having a temperature lower than that of purified water may be used to take heat away from purified water. When cooling water having a temperature lower than that of the purified water is formed via operation of the cooling device, a temperature of the water dispenser may be partially lowered to be lower than a dew point temperature.

When temperatures are lower that the dew point temperature, vapor in the air condenses, and dew in the form of water droplets is formed. When the temperature of the water dispenser is partially lowered to be lower than the dew point temperature, dew may form inside or outside of the water dispenser. For example, dew may be formed on a surface of a valve or a pipe that discharges cooling water when cooling water is discharged outwardly and/or replaced with new cooling water for cleaning. Dew may cause malfunctioning of electronic components installed within the water dispenser, and users may misidentify dew formed in the water dispenser as a water leakage.

BRIEF DESCRIPTION OF THE DRAWINGS

The embodiments will be described in detail with reference to the following drawings in which like reference numerals refer to like elements wherein.

DETAILED DESCRIPTION

Figure 1:
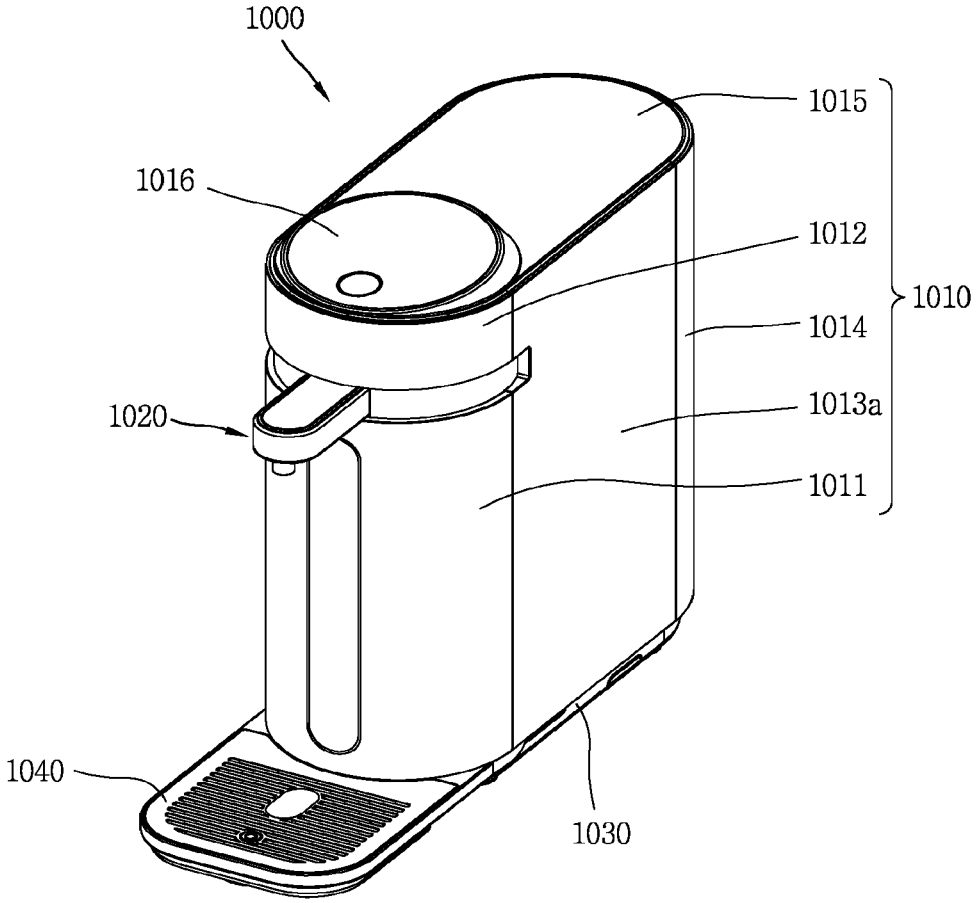
FIG. 1 is a perspective view of a water dispenser according to an embodiment.

Referring to FIG. 1, a water dispenser 1000 according to an embodiment may include a cover 1010, a dispensing unit or dispenser 1020, a base assembly 1030, and a tray 1040. The cover 1010 may form an outer appearance of the water dispenser 1000. Components for filtering raw water may be installed within the cover 1010. The cover 1010 may cover the components to protect the components. The cover 1010 may also be referred to as a case or a housing. Any component may correspond to the cover 1010 as long as it forms an outer appearance of the water dispenser 1000 and is configured to cover components that filter raw water.

The cover 1010 may be formed as a single component or may be formed by combining several components. For example, as illustrated in FIG. 1, the cover 1010 may include a front cover 1011, a rear cover 1014, a side panel 1013*a*, an upper cover 1012, and a top cover 1015. The front cover 1011 may be provided on a front side of the water dispenser 1000. The rear cover 1014 may be provided on a rear side of the water dispenser 1000. The front side and the rear side of the water dispenser 1000 may be in relation to a direction in which a user views the dispenser 1020 straight on. However, the front side and the rear side of the water dispenser 1000 may vary depending on how the water dispenser 1000 is described or from where it is viewed. As shown in FIG. 1, the front cover 1011 and the rear cover 1014 may be curved, but embodiments are not limited thereto.

The side panel 1013*a* may be provided on a left and right side of the water dispenser 1000. The side panel 1013*a* may be provided between the front cover 1011 and the rear cover 1014. The side panel 1013*a* may be coupled to the front cover 1011 and the rear cover 1014. The side panel 1013*a* may substantially form a side surface of the water dispenser 1000. The upper cover 1012 may be provided on a front side of the water dispenser 1000. The upper cover 1012 may be installed in a position higher than the front cover 1011. The dispenser 1020 may be exposed in or protrude from a space between the upper cover 1012 and the front cover 1011. The upper cover 1012 may form an outer appearance of the front side of the water dispenser 1000 together with the front cover 1011.

The top cover 1015 may form an upper surface of the water dispenser 1000. An input/output 1016 may be formed in or on the top cover 1015. The input/output 1016 may include an input and an output. The input may be configured to receive a user's control command. The way in which the input receives a user's control command may include a touch input or a physical pressurization or selectively include any one thereof. The output may be configured to visually and/or audibly provide state information of the water dispenser 1000 to a user.

The dispenser or a cock assembly 1020 may provide purified water to the user according to a user's control command. The dispenser 1020 may protrude from the water dispenser in order to supply water. For example, in a water dispenser 1000 configured to provide purified water at room temperature, cold water at a temperature lower than room temperature, and/or hot water at a temperature higher than room temperature, at least one of room temperature water, hot water, and cold water may be provided to the user through the dispenser 1020.

The dispenser 1020 may be configured to rotate. The dispenser 1020 may rotate within a rotatable range between the front cover 1011 and the upper cover 1012. The dispenser 1020 may be rotated by a force physically applied to the dispenser 1020 by the user. The dispenser 102 may be rotated via a control command applied by the user to the input/output 1016. A component to rotate the dispenser 1020 may be installed within the water dispenser 1000, for example, in a region covered by the upper cover 1020. The input/output 1016 may be rotated together with the dispenser 1020 when the dispenser 1020 rotates.

The base assembly 1030 may form a bottom of the water dispenser 1000. Internal components of the water dispenser 1000 may be supported by the base assembly 1030. When the water dispenser 1000 is placed on a surface such as a floor or a shelf, the base assembly 1030 may face the floor or the shelf. Thus, when the water dispenser 1000 is placed on the surface, the base assembly 1030 may not be exposed or visible.

The tray 1040 may be provided to face the dispenser 1020. When the water dispenser 1000 is installed as illustrated in FIG. 1, the tray 1040 may face the dispenser 1020 in a vertical direction. The tray 1040 may support a container that receives or contains purified water provided through the dispenser 1020. The tray 1040 may accommodate or collect residual water dropped from the dispenser 1020. When the tray 1040 collects residual water dropped from the dispenser 1020, spills or leakage from the water dispenser 1000 due to residual water may be prevented. The tray 1040 may also rotate together with the dispenser 1020. The input/output 1016 and the tray 1040 may rotate together with the dispenser 1020 in a same direction.

Figure 2:
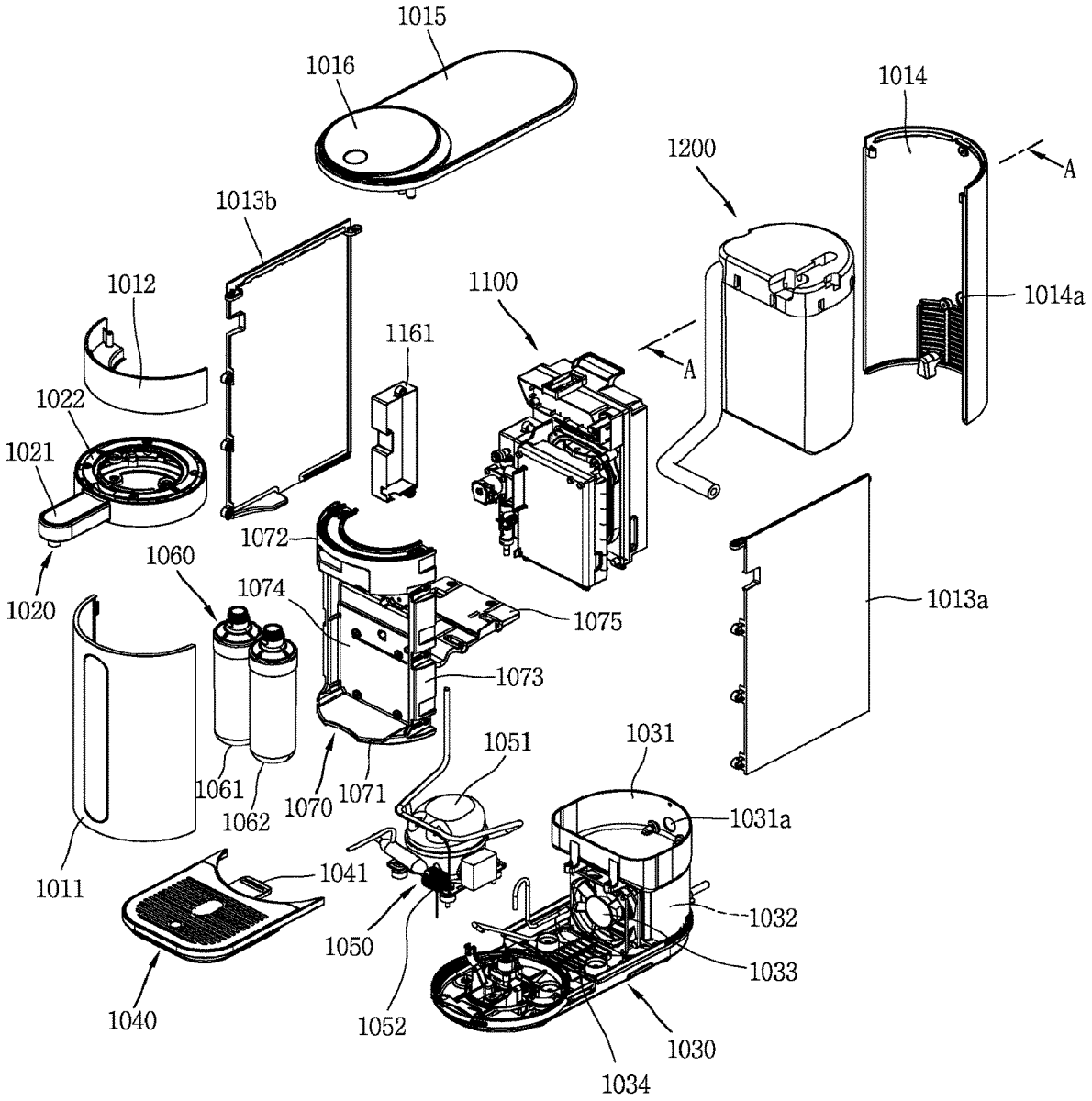
FIG. 2 is an exploded perspective view of an internal configuration of a water dispenser according to an embodiment.

Referring to FIG. 2, the filter 1060 may be installed on an inner side of the front cover 1011. The filter 1060 may be configured to filter raw water so as to produce purified water. The filter 1060 may include a plurality of unit filters 1061 and 1062. The plurality of unit filters 1061 and 1062 may be connected according to a preset order. The unit filters 1061 and 1062 may include, for example, a pre-filter such as a carbon block or an adsorption filter and a highly efficient filter such as a hepa filter or an ultrafiltration (UF) filter. As shown in FIG. 2, two unit filters 1061 and 1062 may be provided, but a number of the unit filters 1061 and 1062 may vary as needed.

The preset order refers to an order appropriate for the filter 1060 to filter raw water. Raw water may include various foreign materials. Highly efficient filters such as a hepa filter or an UF filter may need to be protected from large particles such as hair or dust. Thus, in order to protect these highly efficient filters, an outlet of the pre-filter may need to be connected to an inlet of the highly efficient filter. The pre-filter may be configured to remove large particles from water. When the pre-filter is provided on an upstream side of the highly efficient filter so as to remove large particles included in raw water, water not including those larger particles may be supplied to the highly efficient filter, and thus, the highly efficient filter may be protected. Raw water which has passed through the pre-filter may subsequently be filtered by the hepa filter or the UF filter.

Purified water generated by the filter 1060 may be directly provided to the user through the dispenser 1020. A temperature of the purified water provided to the user may be at room temperature. Alternatively, purified water produced by the filter 1060 may become hot water by an induction heater 1100 or may become cold water by a cold water tank assembly or water tank 1200.

A filter bracket assembly 1070 may fix the unit filters 1061 and 1062 of the filter 1060 and a water ejection flow channel of purified water or cold water or a valve. A lower end 1071 of the filter bracket assembly 1070 may be coupled to the tray 1040. The lower end 1071 of the filter bracket assembly 1070 may accommodate a protrusion coupling portion 1041 of the tray 1040. As the protrusion coupling portion 1041 of the tray 1040 is inserted into the lower end 1071 of the filter bracket assembly 1070, the filter bracket assembly 1070 and the tray 1040 may be coupled.

The lower end 1071 of the filter bracket assembly 1070 and the tray 1040 may have curved surfaces that correspond to each other. The lower end 1071 of the filter bracket assembly 1070 may rotate independently from other remaining portions. An upper end 1072 of the filter bracket assembly 1070 may support the dispenser 1020. The upper end 1072 of the filter bracket assembly 1070 may form a rotation path of the dispenser 1020. The dispenser 1020 may be divided into a first part 1021 that protrudes outwardly from the water dispenser 1000 and a second part 1022 provided within the water dispenser 1000. The second part 1022 may have a circular shape, as illustrated in FIG. 2. The second part 1022 may be mounted on the upper end 1072 of the filter bracket assembly 1070. The upper end 1072 of the filter bracket assembly 1070 may rotate independently from other remaining portions.

The lower end 1071 and the upper end 1072 of the filter bracket assembly 1070 may be connected to each other by a vertical connector 1073. The lower end 1071 and the upper end 1072 of the filter bracket assembly 1070 connected to each other by the vertical connector 1073 may rotate in the same direction. When the user rotates the dispenser 1020, the upper end 1072, the vertical connector 1073, and the lower end 1701 of the filter bracket assembly 1070 connected to the dispenser 1020 and the tray 1040 may be rotated together.

A filter installation region 1074 configured to accommodate the unit filters 1061 and 1062 of the filter 1060 may be formed between the lower end 1071 and the upper end 1072 of the filter bracket assembly 1070. The filter installation region 1074 may provide an installation space for the unit filters 1061 and 1062.

A support 1075 that protrudes toward a rear side of the water dispenser 1000 may be formed on an opposite side of the filter installation region 1074. The support 1075 may be configured to support the induction heater 1100. The induction heater 1100 may be mounted on the support 1075. The support 1075 may prevent heat formed by the induction heater 1100 from being transmitted to a refrigerating cycle 1050, such as, e.g., a compressor 1051 or a capillary tube 1053. The induction heater 1100 may be configured to produce hot water. The induction heater 1100 may receive purified water produced by the filter 1060. In a direct type water dispenser 1000 without a separate water tank, the induction heater 1100 may directly receive purified water from the filter 1060.

Various printed circuit boards (PCBs) to control operation of the water dispenser 1000 may be installed in the induction heater 1100. A protective cover 1161 that prevents penetration of water into the PCBs and protects the PCBs in case of a fire may be coupled to one side of the induction heater 1100.

The compressor 1051 may be provided below the support 1075. In order to produce cold water in the cold water tank assembly 1200, cooling water that fills an interior of the cold water tank assembly 1200 may be at a low temperature via operation of the refrigerating cycle 1050. The refrigerating cycle 1050 may be an aggregation of units in which a processes of compressing, condensing, expanding, and evaporating a refrigerant may be continuously performed. The compressor 1051 may be configured to compress a refrigerant. A refrigerant flow channel that connects respective components of the refrigerating cycle 1050 may be connected to the compressor 1051. The compressor 1051 and units including the refrigerant flow channel may be connected to form the refrigerating cycle 1050.

The compressor 1051 may be supported by the base assembly 1030. The base assembly 1030 may support the front cover 1011, the rear cover 1014, the side panels 1013*a* and 1013*b*, the filter bracket assembly 1070, the condenser 1032, and the fan 1033, as well as the compressor 1051. In order to support these components, the base assembly 1030 may have high rigidity. For example, the condenser and the fan 1033 may be installed on a rear side of the water dispenser 1000, and the base assembly 1030 may have an intake 1034 to dissipate heat from the condenser 1032. Air taken in through the intake 1034 may be moved toward the condenser 1032 by the fan 1033, resulting in an air cooling type cooling. In order to increase heat dissipation efficiency of the condenser 1032, a component having a duct structure to cover the fan 1033 and the condenser 1032 may be fixed to the base assembly 1030.

A holder 1031 to support the cold water tank assembly 1200 may be installed above the condenser 1032. The holder 1031 and the rear cover 1014 may have holes 1031*a* and 1014*a* provided at positions corresponding to each other. The holes 1031*a* and 1014*a* may drain cooling water in the cold water tank assembly 1200 therethrough.

The condenser 1032 may form the refrigerating cycle 1050 together with the compressor 1051. A refrigerant may be condensed in the condenser 1032. Refrigerant expansion may occur via an expander such as a capillary tube 1053. The evaporator 1202 may be installed within the cold water tank assembly 1200.

The cold water tank assembly 1200 may be formed to accommodate cooling water therein. The cold water tank assembly 1200 may receive purified water generated in the filter 1060. In a direct type water dispenser 1000 not having a separate water tank, the cold water tank assembly 1200 may directly receive purified water from the filter 1060. A temperature of cooling water filling the cold water tank assembly 1200 may be lowered according to operation of the refrigerating cycle 1050. The cold water tank assembly 1200 may be configured to cool purified water with cooling water to form cold water.

Cooling water may be stored in the cold water tank assembly 1200 and may not circulate, and thus, contamination of the cooling water may be increased over time. For sanitary purposes, cooling water stored in the cold water tank assembly 1200 may be periodically discharged outward and may be replaced with fresh cooling water.

In a related art cold water tank assembly, a valve or a pipe may serve to discharge cooling water. Since cooling water is maintained at a low temperature, a temperature of the valve or the pipe, in which cooling water may pass, may partially be lower than a dew point temperature. Dew may form at a portion having a temperature lower than the dew point temperature. Embodiments disclosed herein may prevent formation of dew on a component used to discharge cooling water and have a structure different from that of the related art.

Figure 3:
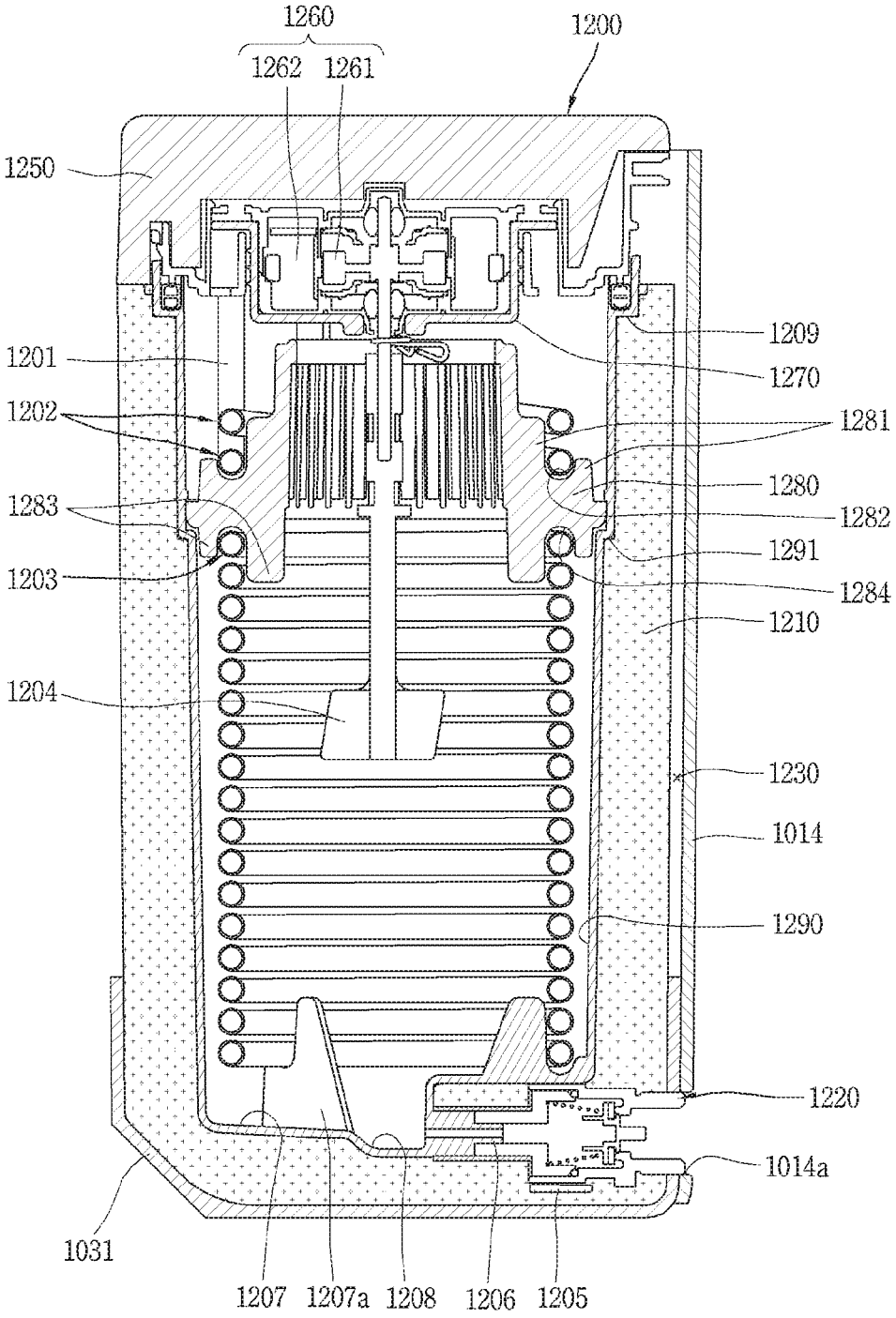
FIG. 3 is a cross-sectional view taken along line A-A of a cold water tank assembly and a rear cover illustrated in FIG. 2.

Referring to FIG. 3, the cold water tank assembly 1200 may include a cooling water accommodation part or container 1290 formed to accommodate cooling water. The cooling water container 1290 may be formed as a storage tank, and an interior of the cooling water container 1290 may be filled with cooling water. Even though the cooling water container 1290 is formed as a storage tank, the water dispenser may be classified as a direct type water dispenser because cooling water for generating cold water, rather than purified water to be provided to a user, is stored in the cooling water container 1290.

An upper end of the cooling water container 1290 may be opened, and an edge of the upper end of the cooling water container 1290 may be provided to be coupled to a cold water tank cover 1250. As cold water tank cover 1250 is coupled to the cooling water container 1290, an internal space of the cooling water container 1290 may be hermetically closed. A thermistor 1201 to measure a temperature of cooling water may be installed within the cold water tank assembly 1200. The thermistor 1201 may measure a temperature of a measurement target using characteristics of a resistance value, which is changed according to temperature. The thermistor 1201 may measure a temperature of cooling water. A temperature of cooling water measured by the thermistor 1201 may be used as a basis to determine an operation of the refrigerating cycle 1050.

When a temperature of cooling water measured by the thermistor 1201 is higher than a first reference temperature, the refrigerating cycle of the water dispenser 1000 may operate to lower the temperature of the cooling water. The compressor 1051 and the condenser 1032 described above with reference to FIG. 2 may compress and condense a refrigerant, and the refrigerant may be expanded in the capillary tube 1053. The expanded refrigerant may pass through the evaporator 1202 installed within the cold water tank assembly 1200. Cooling water stored within the cold water tank assembly 1200 may be heat-exchanged with a refrigerant passing through the evaporator 1202 so as to be cooled.

The evaporator 1202 may be supported by an evaporator support 1280. The evaporator support 1280 may be mounted on a step portion 1291 of the cooling water container 1290 and may support the evaporator 1202. Referring to FIG. 3, the evaporator support 1280 may have a groove 1282, 1284, and the evaporator 1202 may be mounted on the groove.

An agitator 1204 may be installed within the cold water tank assembly 1200. The agitator 1204 may be immersed in cooling water and may be configured to rotate centered on an axis. The agitator 1204 may accelerate heat exchange between fluids within the cold water tank assembly 1200. The agitator 1204 may accelerate heat exchange between cooling water and a refrigerant and between cooling water and purified water.

A motor 1260 may be installed on an upper wall on an inner side of the cold water tank assembly 1200, and the cold water tank cover 1250 may cover the motor 1260. The motor 1260 may include a rotor 1261 that rotates and a stator 1262 that is fixed. The rotor 1261 and the stator 1262 may be accommodated in a motor protector 1270. The motor protector 1270 may cover the motor 1260 to protect the motor 1260 from the cooling water. The agitator 1204 may be connected to the rotor 1261 by a shaft, and when the rotor 1261 rotates, the agitator 1204 may also rotate. The thermistor 1201 may continuously measure a temperature of the cooling water. When a temperature of the cooling water measured by the thermistor 1201 is lower than a second reference temperature, operation of the refrigerant cycle of the water dispenser 1000 may be stopped. The second reference temperature may be lower than the first reference temperature. The first reference temperature and the second reference temperature may be set as references to operate or stop the refrigerant cycle, respectively. A temperature of the cooling water stored in the cold water tank assembly 1200 may be maintained at a temperature between the first reference temperature and the second reference temperature through temperature measurement by the thermistor 1201 and operation of the refrigerant cycle.

A cooling coil 1203 may be a flow channel through which purified water may pass. In FIG. 3, a cross-section of cooling coil 1203 of the flow channel may be shown via reference numeral 1203 to a bottom surface 1207. The cooling coil 1203 may be installed within the cold water tank assembly 1200 and immersed in cooling water. Purified water passing through the cooling coil may be heat-exchanged with cooling water. Heat may be transmitted from the purified water to the cooling water, and the purified water may become cold water through heat exchange with the cooling water within a short time. The agitator 1204 may rotate centered on an axis to accelerate heat exchange between the purified water and the cooling water.

A support 1207*a* may support the cooling coil 1203. The support 1207*a* may protrude from the bottom surface 1207 toward the cooling coil 1203 within the cold water tank assembly 1200. The support 1270*a* may include a recess having a size corresponding to an outer circumferential surface of the cooling coil 1203. The cooling coil 1203 may be mounted in the recess of the support 1207*a* and may be supported by the support 1207*a*.

As described above, cooling water stored in the cold water tank assembly 1200 may be periodically replaced. Cooling water may be drained through a cooling water drain valve or drain valve 1220 that forms a drain flow channel. The cooling water drain valve 1220 may be connected to the cold water tank assembly 1200. The cooling water drain valve 1220 may protrude from the cold water tank assembly 1200 to form a discharge flow channel of the cooling water in the interior of the cold water tank assembly 1200. A connection between the cooling water drain valve 1220 and the cold water tank assembly 1200 may be variously modified. Various embodiments regarding the connection structure will be described with reference to FIG. 6 to FIG. 9.

The cold water tank assembly 1200 may include a protruding drain flow channel 1206. The protruding drain flow channel 1206 may protrude from a lower portion of the cold water tank assembly 1200 and may be connected to the cooling water drain valve 1220. The protruding drain flow channel 1206 may be inserted into the cooling water drain valve 1220. Since the cooling water drain valve 1220 is configured to discharge cooling water out from the water dispenser 1000, when the protruding drain flow channel 1206 is inserted into the cooling water drain valve 1220, a flow channel, which may allow the cooling water stored in the cold water tank assembly 1200 to be drained, may be formed. The cooling water drain valve 1220 may be fixed by a fixing part or holder 1205.

The inner bottom surface 1207 may be sloped to smoothly drain water. Since the cooling water is drained due to natural forces, if the inner bottom surface 1207 of the cold water tank assembly 1200 is flat, the cooling water may pool in a portion of the cold water tank assembly 1200, which may cause contamination and may not be sanitary. As illustrated in FIG. 3, when the inner bottom surface 1207 of the cold water tank assembly 1200 is sloped toward the drain flow channel, pooling of the cooling water may be prevented.

The cold water tank assembly 1200 may include an anti-pooling portion 1208. The anti-pooling portion 1208 may form a drain flow channel together with the cooling water drain valve 1220. The anti-pooling portion 1208 may be formed by depressing the inner bottom surface 1207 of the cold water tank assembly 1200. The anti-pooling portion 1208 may form a bottom surface lower than the inner bottom surface 1207 of the cold water tank assembly 1200, and at least a portion thereof may be sloped.

The anti-pooling portion 1208 may be configured to collect the cooling water in the cold water tank assembly 1200 and supply the same to the cooling water drain valve 1220. Since the anti-pooling portion 1208 forms a bottom surface lower than the inner bottom surface 1207 and is sloped, cooling water may not pool on the inner bottom surface 1207. The cooling water may be collected in the anti-pooling portion 1208 and discharged through the cooling water drain valve 1220.

The water dispenser 1000 may include a foam insulator 1210 that insulates the cold water tank assembly 1200. The foam insulator 1210 may surround or cover an outer circumferential surface of the cold water tank assembly 1200 to cold-insulate the cold water tank assembly 1200. A temperature of the cooling water in the interior of the cold water tank assembly 1200 may reach room temperature, and the foam insulator 1210 may serve to restrain transmission of heat in the air from the cooling water, thus lengthening the amount of time for the temperature of the cooling water to reach room temperature.

The foam insulator 1210 may surround the cooling water drain valve 1220 to prevent formation of dew on the cooling water drain valve 1220. The foam insulator 1210 may closely contact the cooling water drain valve 1220 to prevent being exposed to air. When the cooling water drain valve 1220 is prevented from being in contact with air, formation of dew thereon may be prevented. The foam insulator 1210 may prevent the cooling water drain valve 1220 from being in contact with air to prevent formation of dew on an outer circumferential surface of the cooling water drain valve 1220. The foam insulator 1210 may surround the cooling water drain valve 1220, as well as the cold water tank assembly 1200. Thus, the foam insulator 1210 may cold-insulate the cold water tank assembly 1200 and prevent formation of dew on the cooling water drain valve 1220.

The foam insulator 1210 may be formed of polyurethane (PU), and may be formed through a foaming process. Thus, the foam insulator 1210 may be referred to as a PU foam. While an insulator called expandable polystyrene (EPS) may be used to cold-insulate a water dispenser, there may be a gap in the EPS such that it may not be possible to prevent contact between the cooling water drain valve 1220 and air by the EPS. In contrast, the foam insulator 1210 formed of PU and formed through a foaming process does not have a gap, and thus, may prevent contact between the cooling water drain valve 1220 and air. The foaming process may be performed in a foaming jig, and the foam insulator 1210 may be formed through a process called nude foaming. The foaming process may be performed in order as follows.

The cold water tank assembly 1200 and the cooling water drain valve 1220 may be assembled and subsequently introduced to a foaming jig. Thereafter, a crude liquid, for example, a bubble solution formed as a mixture of polyurethane and a foaming agent, of the foam insulator 1210 may be introduced to the foaming jig and a foaming process may be performed. When the foaming process is completed, the foam insulator 1210 surrounding an outer circumferential surface of the cold water tank assembly 1200 may be formed. The foam insulator 1210 formed through the foaming process may cover even the cooling water drain valve 1220, as well as the cold water tank assembly 1200.

The cold water tank assembly 1200 may include a barrier 1209 to prevent the bubble solution from flooding during the foaming process. The barrier 1209 may protrude along an outer circumferential surface of an upper portion of the cold water tank assembly 1200. The barrier 1209 that protrudes from the cold water tank assembly 1200 may be in contact with an inner circumferential surface of the foaming jig to prevent the bubble solution introduced to the foaming jig from flooding.

When the foaming process is completed, the cold water tank assembly 1200, the cooling water drain valve 1220, and the foam insulator 1210 may be integrally formed. The foam insulator 1210 may be provided to be spaced apart from the cover 1010. The cover 1010 may be at least one of the front cover 1011, the side panel 1013*a*, and the rear cover 1014, depending on an installation position of the cold water tank assembly 1200. With respect to the position of the cold water tank assembly 1200 described above with reference to FIG. 2, the cover 1010 herein may refer to the rear cover 1014. However, embodiments are not limited thereto.

Since the foam insulator 1020 and the rear cover 1014 are spaced apart from one another, an air gap 1230 may be formed between an outer circumferential surface of the foam insulator 1210 and an inner circumferential surface of the rear cover 1014. The air gap 1230 may also cold-insulate the cold water tank assembly 1200. Compared with a structure in which the foam insulator 1210 is in contact with the rear cover 1014, a structure in which the air gap 1230 separates the foam insulator 1210 and the rear cover 1014 may be more advantageous for cold-insulating the cold water tank assembly 1200 because the air gap 1230 may restrict heat conduction.

The air gap 1230 may also cold-insulate the cold water tank assembly 1200, but when the cooling water drain valve 1220 is exposed to the air gap 1230, formation of dew on the cooling water drain valve 1220 may not be prevented. In order to prevent formation of dew on the cooling water drain valve 1220, an outer circumferential surface of the cooling water drain valve 1220 may be completely covered by the foam insulator 1210 and the rear cover 1014. Since the cooling water drain valve 1220 is covered by the foam insulator 1210 and the rear cover 1014, even though the air gap 1230 is present between the rear cover 1014 and the foam insulator 1210, the cooling water drain valve 1220 may not be exposed to the air gap 1230.

Referring to FIG. 3, the water dispenser 1000 may include a support 1031 formed to cover a lower portion of the cold water tank assembly 1200. The support 1031 may separate the foam insulator 1210 and the cover 1010 to form the air gap 1230. In order to prevent formation of dew on the cooling air drain valve 1220, an outer circumferential surface of the cooling water drain valve 1220 may be covered by the foam insulator 1210, the support 1031, and the cover 1010.

Although the air gap 1230 is present, the structure in which the cooling water drain valve 1220 is continuously covered by the foam insulator 1210 and the cover 1010 and the structure in which the cooling water drain valve 1220 is continuously covered by the foam insulator 1210, the support 1031, and the cover 1010 may prevent the cooling water drain valve 1220 from being exposed to the air gap 1230. Since the cooling water drain valve 1220 is not exposed to the air gap 1230, formation of dew on the outer circumferential surface of the cooling water drain valve 1220 may be prevented in spite of the presence of the air gap 1230.

Figure 4:
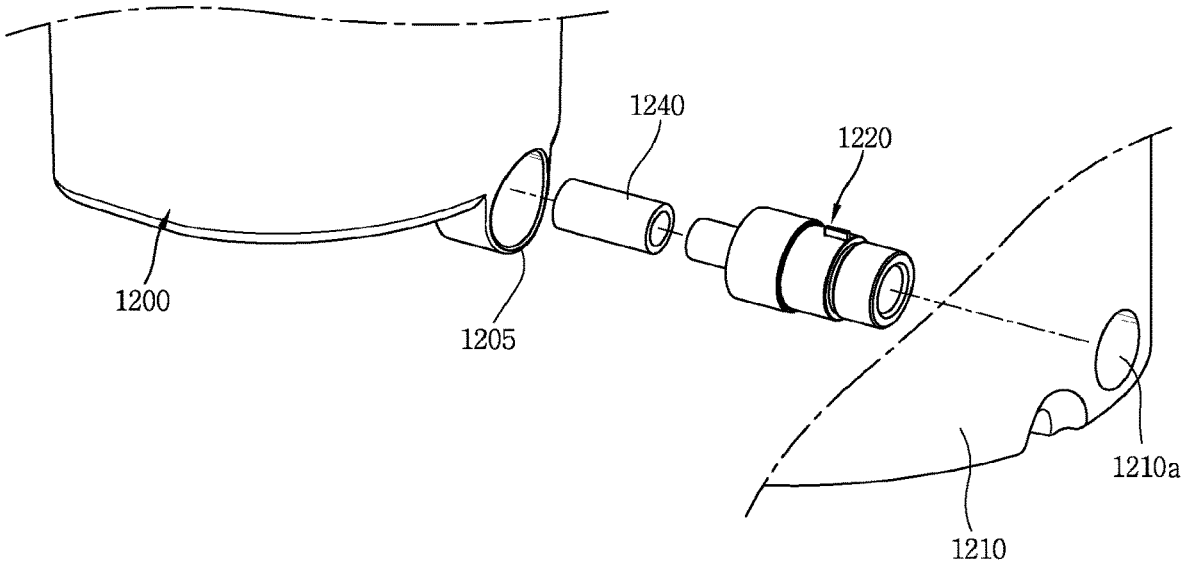
FIG. 4 is a conceptual view of a cold water tank assembly, a cooling water drain valve, and a foam insulator.

Referring to FIG. 4, the cold water tank assembly 1200 may include the holder 1205 to fix a position of the cooling water drain valve 1220. The holder 1205 may protrude from a lower portion of the cold water tank assembly 1200. The holder 1205 may cover or surround at least a portion of the cooling water drain valve 1220. The holder 1205 may be formed to correspond to a shape of the cooling water drain valve 1220. For example, as illustrated in FIG. 4, if the cooling water drain valve 1220 has a cylindrical shape, at least a portion of the holder 1205 may have an annular shape to surround the cooling water drain valve 1220. If the cooling water drain valve 1220 is another shape, a structure of the holder 1205 may also be changed according to the shape of the cooling water drain valve 1220.

The holder 1205 may fix a position of the cooling water drain valve 1220 during a foaming process. During the foaming process, the cold water tank assembly 1200 and the cooling water drain valve 1220 may be immersed in a bubble solution within a foaming jig. The cooling water drain valve 1220 may deviate from a normal position thereof due to buoyancy provided by the bubble solution. The holder 1205 may surround the cooling water drain valve 1220 to restrict movement of the cooling water drain valve 1220 and reduce movement due to buoyancy.

The holder 1205 may fix a position of the cooling water drain valve 1220 during the foaming process, and even after the foaming process is completed, the holder 1205 may fix the position of the cooling water drain valve 1220. With the foaming process completed, the cooling water drain valve 1220 is not likely to release from the normal position, but there may be a possibility in which the foam insulator 1210 may be deformed or damaged by an external force or impact. Even though the foam insulator 1210 is deformed or damaged, since the holder 1205 surrounds the cooling water drain valve 1220, the cooling water drain valve 1220 may be protected by the holder 1205.

A sealing member or seal 1240 may prevent the cooling water from leaking through a gap formed in a connection portion between the cold water tank assembly 1200 and the cooling water drain valve 1220. The seal 1240 may be formed to surround the connection portion between the cold water tank assembly 1200 and the cooling water drain valve 1220. The seal 1240 may connect and seal the cold water tank assembly 1200 and the cooling water drain valve 1220.

The seal 1240 may seal the connection portion between the cold water tank assembly 1200 and the cooling water drain valve 1220 during the foaming process, as well as during operation of the cooling water drain valve 1220. The foaming process of forming the foam insulator 1210 may include a step of injecting a bubble solution, and thus, there may be a possibility in which the bubble solution may penetrate through the connection portion between the cold water tank assembly 1200 and the cooling water drain valve 1220. Thus, sealing of the cold water tank assembly 1200 and the cooling water drain valve 1220 may be needed for proper foaming.

The seal 1240 may be coupled to the cold water tank assembly 1200 and the cooling water drain valve 1220 before the foaming process. Thus, the seal 1240 may prevent penetration of the bubble solution through the connection portion between the cold water tank assembly 1200 and the cooling water drain valve 1220.

The seal 1240 may have a hollow cylindrical shape. When the seal 1240 having such a shape is mass-produced, the seal 1240 may be manufactured through a manufacturing method called extrusion. Extrusion may refer to a process of continuously manufacturing a product with a cross-section having a predetermined tubular or bar shape. Extrusion may be a processing method of introducing an extrusion material into a container and continuously pushing or thrusting out the extrusion material in a hole having a shape desired to be manufactured. A cross-section of a product released from the hole may be uniform. When product manufactured thusly is cut into units of the seal 1240, the seal 1240 may be mass-produced. In particular, extrusion may be more advantageous for mass-production compared to injection molding.

The foam insulator 1210 may surround the cold water tank assembly 1200 and the cooling water drain valve 1220. The foam insulator 1210 may have a hole 1210*a* that faces the cooling water drain valve 1220. The hole 1210*a* of the foam insulator 1210 may be naturally formed during the foaming process of forming the foam insulator 1210.

Referring to FIG. 2 and FIG. 4, an outlet of the cooling water drain valve 1220 or an end portion of the cooling water drain valve 1220 may be visible through the hole 1210*a* of the foam insulator 1210, the hole 1031*a* of the holder 1031, and the hole 1014*a* of the rear cover 1014. The outlet of the cooling water drain valve 1220 or the end portion of the cooling water drain valve 1220 may be exposed to air. The structure in which the foam insulator 1210 surrounds the cooling water drain valve 1220 to prevent formation of dew on the cooling water drain valve 1220 may be implemented by a mechanical cooling water drain valve 1220.

Figure 5:
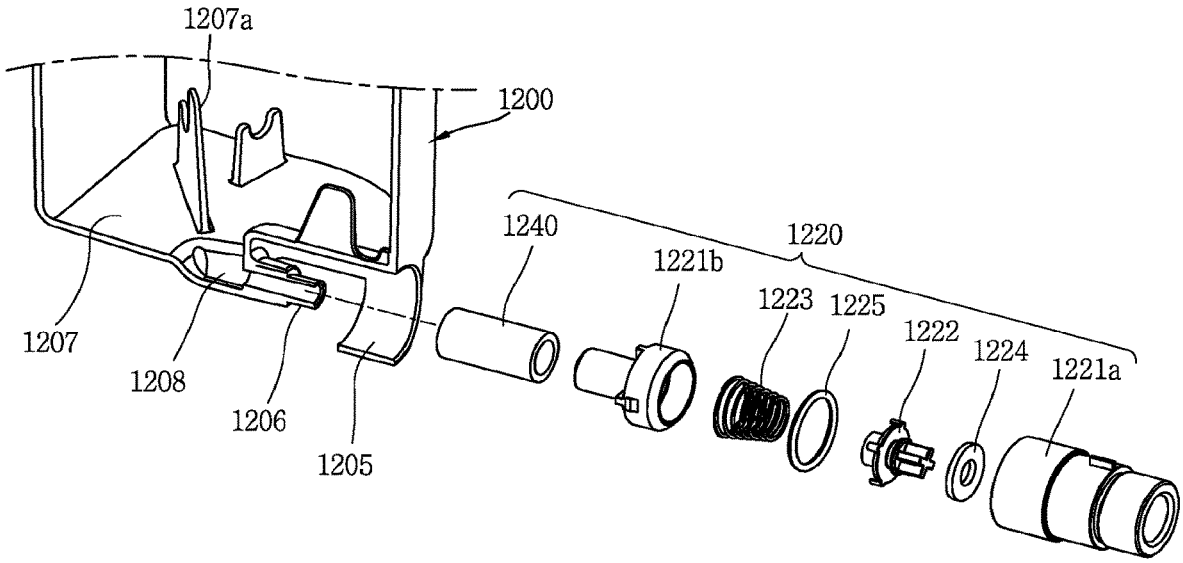
FIG. 5 is an exploded conceptual view of a cross-section of a cold water tank assembly and a cooling water drain valve.

Referring to FIG. 5, the cold water tank assembly 1200 may include a protruding drain flow channel 1206 connected to the cooling water drain valve 1220. The protruding drain flow channel 1206 may be integrally formed with the anti-pooling portion 1208. The protruding drain flow channel 1206 may protrude from the cold water tank assembly 1200. The protruding drain flow channel 1206 may protrude outwardly from the water dispenser 1000.

With respect to a flow of drained cooling water, the anti-pooling portion 1208, the protruding drain flow channel 1206, and the cooling water drain valve 1220 may form a continuous cooling water drain flow channel. When cooling water is drained, the cooling water may sequentially pass through the anti-pooling portion 1208, the protruding drain flow channel 1206, and the cooling water drain valve 1220 so as to be discharged outward.

A structure of the protruding drain flow channel 1206 may be deformed depending on a connection structure with the cooling water drain valve 1220. First to fourth embodiments regarding the connection structure between the protruding drain flow channel 1206 and the cooling water drain valve 1220 may be described with reference to FIG. 6 to FIG. 9. A connection structure illustrated in FIG. 5 may correspond to a first embodiment.

The cooling water drain valve 1220 may include housings 1221*a* and 1221*b*, a pressing part 1222, an elastic member 1223, a first O-ring 1224, and a second O-ring 1225. The housings 1221*a* and 1221*b* may form a shape of the cooling water drain valve 1220. As shown in FIG. 5, the housings 1221*a* and 1221*b* may have a cylindrical shape with a step formed on an outer circumferential surface thereof. However, the present disclosure is not limited thereto. The housings 1221*a* and 1221*b* may have a hollow portion. The hollow portion may correspond to a drain flow channel draining cooling water and to a space accommodating the pressing part 1222 and the elastic member 1223.

As discussed above, the housings 1221*a* and 1221*b* may be surrounded by the foam insulator 1210. Since the foam insulator 1210 surrounds the housings 1221*a* and 1221*b*, the housings 1221*a* and 1221*b* may be prevented from being in contact with air. Thus, even though cold cooling water is drained through the hollow portion, the housings 1221*a* and 1221*b* may not contact with air. Through this structure, formation of dew on the cooling water drain valve 1220 may be prevented.

The housings 1221*a* and 1221*b* may be formed by coupling a first housing 1221*a* and a second housing 1221*b*. When any one of the first housing 1221*a* and the second housing 1221*b* is inserted into the other, the first housing 1221*a* and the second housing 1221*b* may be coupled. The first housing 1221*a* may be an outlet though which cooling water may be discharged from the cooling water drain valve 1220. The second housing 1221*b* may correspond to an inlet through which cooling water may be received from the cold water tank assembly 1200. Thus, with respect to a flow of cooling water drained from the cold water tank assembly 1200, the first housing 1221*a* may be provided on a downstream side compared to the second housing 1221*b*.

The pressing part 1222 may be provided within the housings 1221*a* and 1221*b*. An interior of the housings 1221*a* and 1221*b* may be hollow. The pressing part 1222 may be pressed by a user. The user's pressing operation may open and close a drain flow channel of the cooling water drain valve 1220.

The first O-ring 1224 may seal a space between the pressing part 1222 and the first housing 1221*a*. The first O-ring 1224 may be coupled to the pressing part 1222 and tightly attached to the housing by elastic force provided by the elastic member 1223. The first O-ring 1224 may be formed of a material having elasticity. Since the first O-ring 1224 seals a space between the pressing part 1222 and the first housing 1221*a*, the drain flow channel may be closed.

The elastic member 1223 may provide an elastic force so that the pressing part 1222 may be tightly attached to the first housing 1221*a*. The elastic member 1223 may be provided at an upstream side compared to the pressing part 1222 and may be supported by the second housing 1221*b*. The second O-ring 1225 may be formed to have an annular shape. The second O-ring may seal a connection portion between the first housing 1221*a* and the second housing 1221*b*. The second O-ring 1225 may be formed of a material having elasticity.

An end portion of the protruding drain flow channel 1206 illustrated in FIG. 5 may be a size that can be inserted into the hollow of the second housing 1221*b*. An outer circumferential surface of the protruding drain flow channel 1206 may have a step. The second housing 1221*b* may accommodate the end portion of the protruding drain flow channel 1206. For example, the second housing 1221*b* may surround an outer circumferential surface of the protruding drain flow channel 1206. The second housing 1221*b* may be limited in movement by the step present on the outer circumferential surface of the protruding drain flow channel 1206. Thus, the step of the protruding drain flow channel 1206 may fix a position of the second housing 1221*b*.

Referring to FIG. 5, the holder 1205 may surround only a portion of the outer circumferential surface of the cooling water drain valve 1220, rather than surrounding an entirety of the protruding drain flow channel 1206 and the cooling water drain valve 1220. Accordingly, the cooling water drain valve 1220 may be visible from a lower end of the cold water tank assembly 1200.

For example, an outer bottom surface of the cold water tank assembly 1200 may partially surround the protruding drain flow channel 1206 in a position spaced apart from the outer circumferential surface of the protruding drain flow channel 1206. The outer bottom surface may refer to a surface opposite the inner bottom surface 1207 denoted by reference numeral 1207 in FIG. 5. When the cold water tank assembly 1200 is viewed in a direction in which the cooling water drain valve 1220 is coupled to the protruding drain flow channel 1206, the outer bottom surface may partially have an arch-shaped cross-section to partially surround the protruding drain flow channel 1206 to prepare a space for the cooling water drain valve 1220 and the seal 1240. Also, the outer bottom surface may surround a portion of the protruding drain flow channel 1206, rather than the entirety thereof, to expose the protruding drain flow channel 1206 through another remaining portion not surrounded by the outer bottom surface.

The holder 1205 may protrude from the outer bottom surface of the cold water tank assembly 1200 to surround the cooling water drain valve 1220. The holder 1205 may have an annular shape. The holder 1205 may surround the cooling water drain valve 1220 in a position not covering the connection portion between the protruding drain flow channel 1206 and the cooling water drain valve 1220. Since the protruding drain flow channel 1206 is surrounded by the seal 1240, the holder 1205 may surround the cooling water drain valve 1220 in a position not covering the seal 1240. The holder 1205 may surround the cooling water drain valve 1220 together with the cold water tank assembly 1200. A hole formed by the annular holder 1205 may face the outlet of the protruding drain flow channel 1206.

Through this structure, visual checks may be made before the foaming process for whether the protruding drain flow channel 1206 and the cooling water drain valve 1220 are properly connected and whether sealing is properly made by the seal 1240. When the foaming process is completed, the seal 1240 may be covered by the foam insulator 1210.

Figure 6:
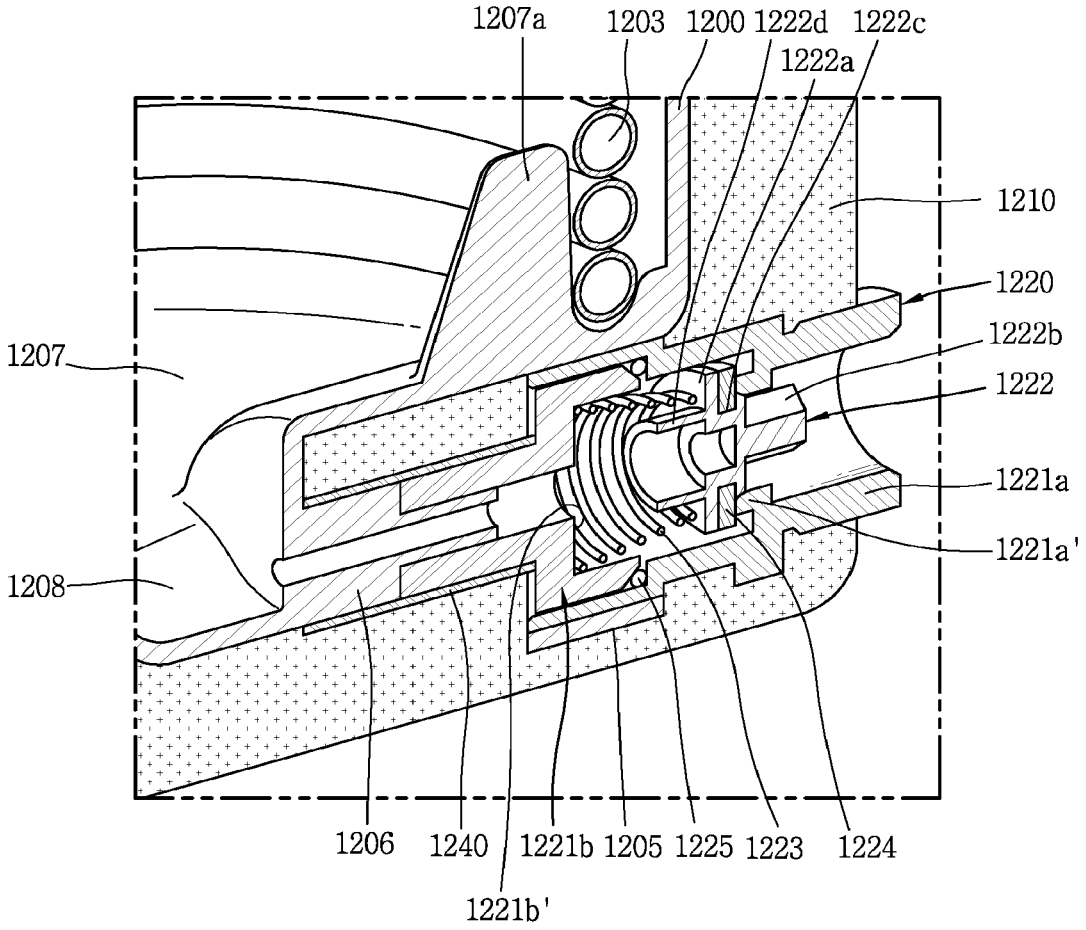
FIG. 6 is a cross-sectional view of a coupling structure of a cold water tank assembly and a cooling water drain valve according to an embodiment.

Referring to FIG. 6, the first housing 1221*a* and the second housing 1221*b* may be coupled or fastened through, for example, screw fastening, press-fitting, or hook fastening. Any one of the first housing 1221 and the second housing 1221*b* may surround an outer circumferential surface of the other. For example, referring to FIG. 6, the first housing 1221*a* may surround an outer circumferential surface of the second housing 1221*b*.

The second housing 1221*b* may have a sloped surface at a portion coupled to the first housing 1221*a*. Due to the sloped surface of the second housing 1221*b*, a gap may be formed between the second housing 1221*b* and the first housing 1221*a*. The second O-ring 1225 may be inserted into the gap to seal the connection portion between the first housing 1221*a* and the second housing 1221*b*. The second O-ring 1225 may prevent leakage of the cooling water through the connection portion between the first housing 1221*a* and the second housing 1221*b*.

The first housing 1221*a* may have a stop protrusion 1221*a*'. The second housing 1221*b* may have a step 1221*b*'. With respect to a flow of drained cooling water, the first housing 1221*a* may be provided on a downstream side of the second housing 1221*b*, and thus, the stop protrusion 1221*a*' of the first housing 1221*a* may be referred to as a downstream side stop protrusion 1221*a*' and the step 1221*b*' of the second housing 1221*b* may be referred to as an upstream side step 1221*b*. For the purposes of description, the downstream side stop protrusion 1221*a*' and the upstream side step 1221*b*' will be simply referred to as the stop protrusion 1221*a*' and the step 1221*b*'. The downstream side and the upstream side are based on relative position comparison between the first housing 1221*a* and the second housing 1221*b*. The stop protrusion 1221*a*' may protrude from an inner circumferential surface of the first housing 1221*a*. The stop protrusion 1221*a*' may protrude along the inner circumferential surface of the first housing 1221*a* and may have an annular shape.

The pressing part 1222 may be divided into a first portion 1222*a* and a second portion 1222*b*. With respect to the stop protrusion 1221*a*', an interior and an exterior of the cooling water drain valve 1220 may be differentiated. Under this differentiation, the first portion 1222*a* may refer to a portion provided within the cooling water drain valve 1220 and the second portion may refer to a portion outwardly exposed from the cooling water drain valve 1220.

The first portion 1222*a* may be provided to be caught by the stop protrusion 1221*a*'. The first portion 1222*a* may be in the form of a plate. However, the first portion 1222*a* may have any other shape. For example, the first portion 1222*a* may have a disk plate shape or a polygonal plate shape. A size of a hollow portion provided in the housing 1221*a* may not be uniform and may be varied according to shapes of an inner circumferential surface of the housing 1221*a*. When the stop protrusion 1221*a*' protrudes from the inner circumferential surface of the first housing 1221*a*, a size of the hollow portion in a position where the stop protrusion 1221*a*' is present may be smaller than a region adjacent thereto. For the purposes of description, a hollow portion in a position where the stop protrusion 1221*a*' is present may be referred to as an stop protrusion hollow portion.

The first portion 1222*a* may have a size larger than that of the stop protrusion hollow portion. Thus, the first portion 1222*a* may be caught by the stop protrusion 1221*a*'. Even though elastic force is provided to the pressing part 1222, movement of the pressing part 1222 may not be restricted by the stop protrusion 1221*a*'. Thus, the pressing part 1222 may not be released from the interior of the housing 1221*a* due to the presence of the stop protrusion 12212*a'*.

The second portion 1222*b* may be exposed outwardly and pressed. The pressing operation may refer to an input to open and close the cooling water drain valve 1220. The second portion 1222*b* may protrude from the first portion 1222*a* to outside of the cooling water drain valve 1220. The second portion 1222*b* may be visible to an outside. The second portion 1222*b* may be in contact with the stop protrusion 1221*a*' or may not.

The first O-ring 1224 may be installed between the stop protrusion 1221*a*' and the pressing part 1222. The first O-ring 1224 may be coupled to an outer circumferential surface of the pressing part 1222. The pressing part 1222 may have a circular recess 1222*c* formed along an outer circumferential surface between the first portion 1222*a* and the second portion 1222*b*. The first O-ring 1224 may be inserted into the circular recess 1222*c*.

The first portion 1222*a* may be provided with elastic force from the elastic member 1223. The first O-ring 1224 may be pressed by the first portion 1222*a* and tightly attached to the stop protrusion 1221*a*'. When the first O-ring 1224 is tightly attached to the stop protrusion 1221*a*', the cooling water drain valve 1220 may be closed. When the user presses the pressing part 1222 toward the elastic member 1223 by applying external force to the second portion 1222*b*, the first O-ring 1224 tightly attached to the stop protrusion 1221*a*' may be separated from the stop protrusion 1221*a*' and the cooling water drain valve 1220 may be opened. Opening of the cooling water drain valve 1220 may be made by the external force applied to the pressing part 1222, and closing of the cooling water drain valve 1220 may be made by elastic force provided by the elastic member 1223.

The step 1221*b*' may be formed in the hollow portion of the second housing 1221*b*. The hollow portion of the second housing 1221*b* may not be uniform in size of a circumference thereof, and may have a region in which the size of the circumference thereof may be relatively large and a region in which the size of the circumference thereof may be relatively small. The hollow portion of the second housing 1221*b* may vary in size in relation to the step 1221*b*'. The step 1221*b*' may be formed due to a difference in size between circumferences.

The elastic member 1223 may be installed in a position supported by the step 1221*b*' of the second housing 1221*b*. The pressing part 1222 may have a boss portion 1222*d* that protrudes toward the elastic member 1223 from the first portion 1222*a*. The elastic member 1223 may be formed to surround an outer circumferential surface of the boss portion 1222*d*. Since movement of the elastic member 1223 is limited by the boss portion 1222*d*, the boss portion 1222*d* may prevent the elastic member 1223 from being released from a normal position thereof.

The first portion 1222*a* of the pressing part 1222 may have a first surface and a second surface. The first surface and the second surface may face in substantially opposite directions. An elastic member 1223 may be tightly attached to the first surface, and the first O-ring 1224 may be coupled to the second surface. When the elastic member 1223 presses the first surface, the first O-ring 1224 may be pressed and tightly attached to the stop protrusion 1221*a*' by the second surface.

The mechanical cooling water drain valve 1220 may be distinguished from an electronic valve. For example, an electronic valve, such as a solenoid valve, may be operated according to an input of an electrical signal. In contrast, the mechanical cooling water drain valve 1220 may be operated by applying a physical force.

The electronic valve may operate abnormally or may be broken down when exposed to water. In order to apply the electronic valve to a water system, such as, e.g., a water dispenser or a refrigerator, the electronic valve should be provided as far as possible from water. However, when the electronic valve is provided in a position distant from water, dew may form on a surface of the electronic valve or a pipe connected to the electronic valve.

In order to solve the problem, embodiments disclosed herein provide a mechanical cooling water drain valve 1220. The mechanical cooling water drain valve 1220 does not require an electrical signal. Thus, the mechanical cooling water drain valve 1220 may not be as vulnerable to water and may be advantageously provided adjacent to water. The mechanical cooling water drain valve 1220 may be directly connected to the cold water tank assembly 1200.

In order to surround both the cold water tank assembly 1200 and the cooling water drain valve 1220, the cold water tank assembly 1200 and the cooling water drain valve 1220 may need to be close to each other. If an electronic valve is applied to a water dispenser, the electronic valve may inevitably be spaced apart from the cold water tank assembly 1200, and both the cold water tank assembly 1200 and the electronic valve cannot be covered with the foam insulator 1210.

If the mechanical cooling water drain valve 1220 is applied, the cooling water drain valve 1220 and the cold water tank assembly 1200 may be provided to be adjacent to each other, and both the cold water tank assembly 1200 and the cooling water drain valve 1220 may be covered. Covering the cooling water drain valve 1220 with the foam insulator 1210 may block contact with air to eventually prevent formation of dew. Since the cold water tank assembly 1200 and the cooling water drain valve 1220 are directly connected, a pipe to connect the cold water tank assembly 1200 and the cooling water drain valve 1220 may not be required. Dew may be formed on a pipe in which cooling water flows. When such a pipe is not required, a factor that causes formation of dew may be fundamentally eliminated.

Figure 7:
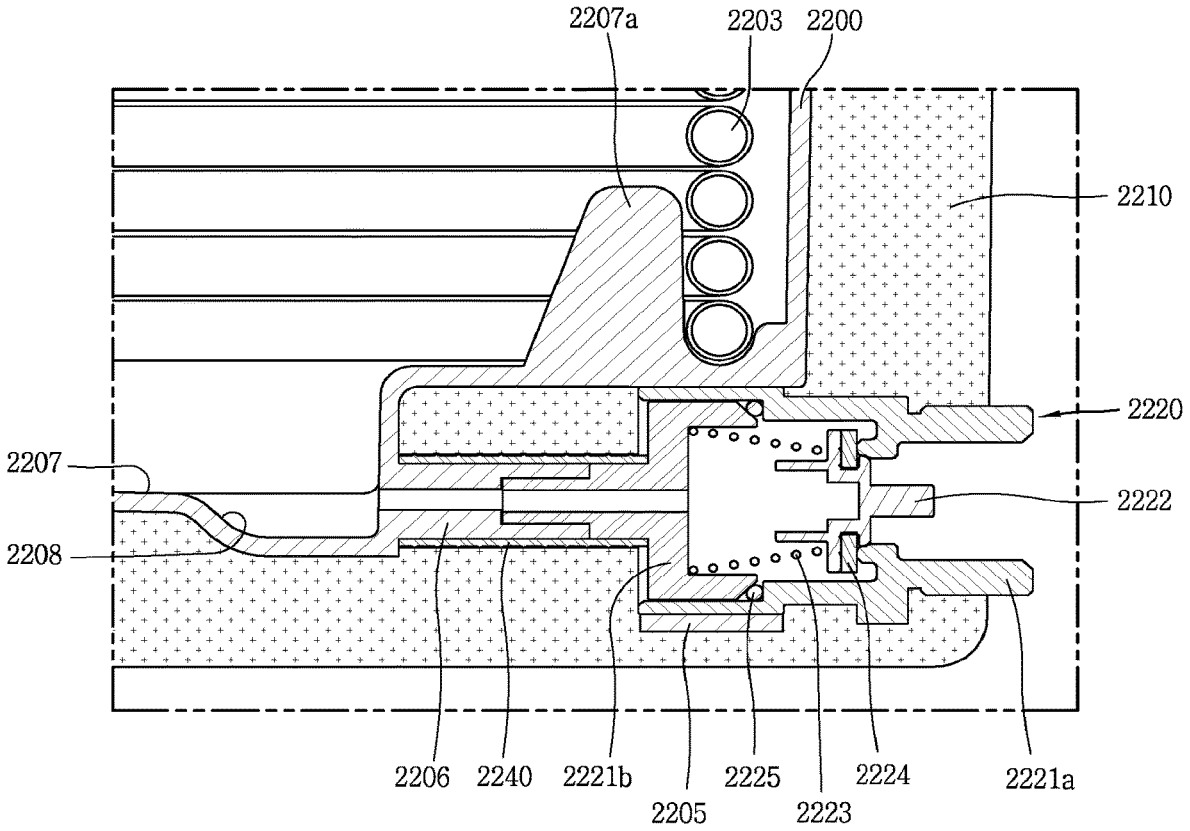
FIG. 7 is a cross-sectional view of a coupling structure of a cold water tank assembly and a cooling water drain valve according to another embodiment.

FIG. 7 is a cross-sectional view of another embodiment regarding a coupling structure of a cold water tank assembly 2200 and a cooling water drain valve 2220. Other components of the cooling water drain valve 2220 excluding a shape of a second housing 2221*b* may be substantially the same as that of the first embodiment described above with reference to FIG. 6, and description thereof have been omitted.

A protruding drain flow channel 2206 may be formed to accommodate an end portion of the second housing 2221*b*. The second housing 2221*b* may be inserted into a hollow portion of the protruding drain flow channel 2206. A seal 2240 may surround a connection portion between the protruding drain flow channel 2206 and the second housing 2221*b*. A foam insulator 2210 may surround the cold water tank assembly 2200, the cooling water drain valve 2220, and the seal 2240. The seal 2240 of the second embodiment may have a uniform cross-section, and thus, may be manufactured by extrusion.

Figure 8:
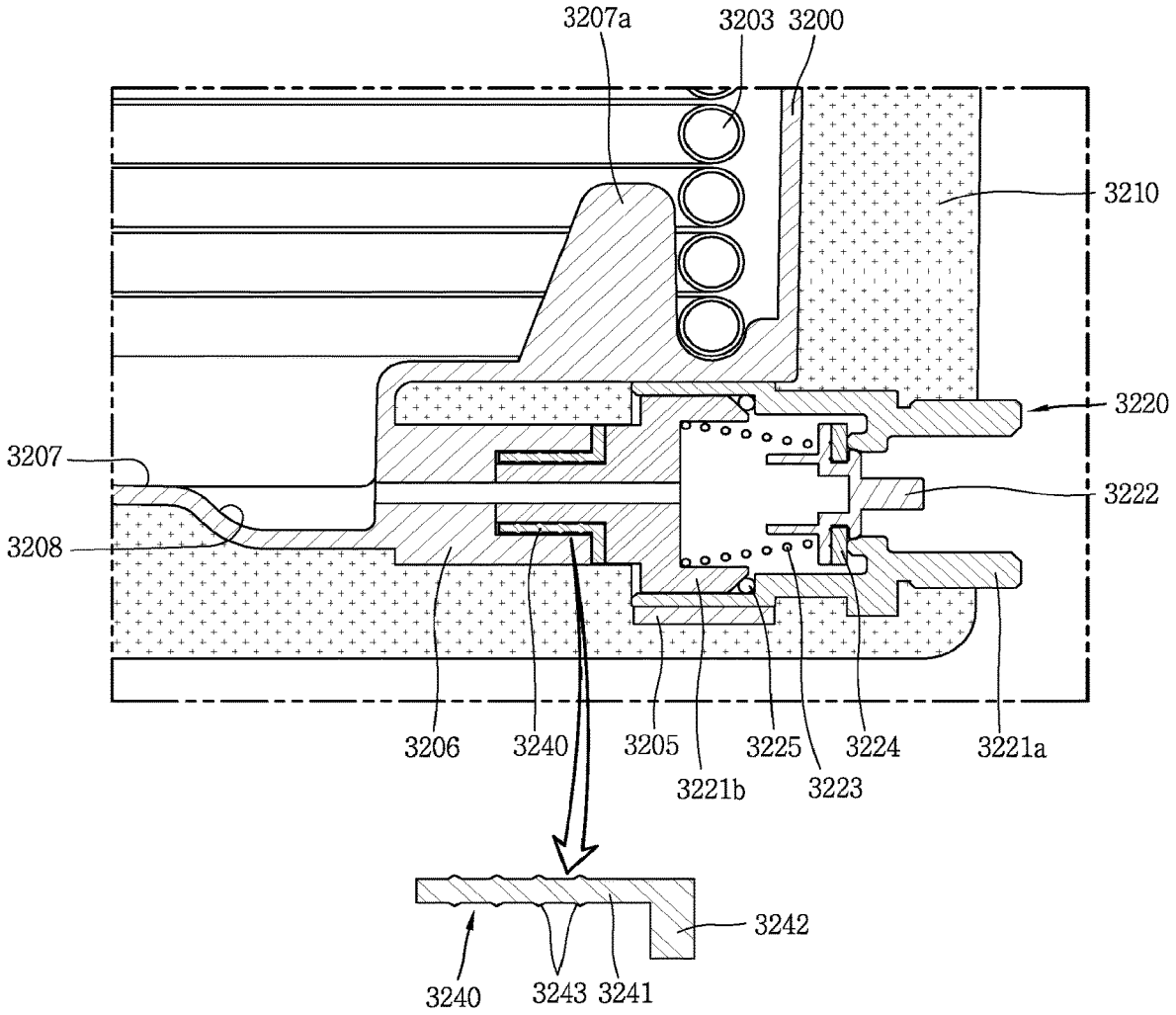
FIG. 8 is a cross-sectional view of a coupling structure of a cold water tank assembly and a cooling water drain valve according to another embodiment.

FIG. 8 is a cross-sectional view of another embodiment regarding a coupling structure of a cold water tank assembly 3200 and a cooling water drain valve 3220. A protruding drain flow channel 3206 may be formed to accommodate a second housing 3221*b*. The second housing 3221*b* may be inserted into a hollow portion of the protruding drain flow channel 3206.

A seal 3240 of the third embodiment may be inserted between the protruding drain flow channel 3206 and the second housing 3221*b*. When the seal 3240 inserted between the protruding drain flow channel 3206 and the second housing 3221*b* has a hollow cylindrical shape, the seal 3240 may be pushed during a process of coupling the cooling water drain valve 3220 and the protruding drain flow channel 3206. Since the seal 3240, which may be fixed to a normal position thereof, may be pushed due to frictional force and released from the normal position, the connection portion between the protruding drain flow channel 3206 and the cooling water drain valve 3220 may not be properly sealed. Thus, the seal 3240 inserted between the protruding drain flow channel 3206 and the second housing 3221*b* may be required to have a structure to prevent a push or movement.

The seal 3240 may include a shaft portion 3241, a head portion 3242, and a protrusion portion 3243. The shaft portion 3241 may have an annular shape. The shaft portion 3241 extending in an axial direction may be formed to have a cylindrical shape having a hollow portion. The shaft portion 3241 may be inserted between the cooling water drain valve 3220 and the protruding drain flow channel 3206. Referring to FIG. 8, the shaft portion 3241 may be inserted into an outer circumferential surface of a second housing 3221*b* and an inner circumferential surface of the protruding drain flow channel 3206. In the seal 3240, the shaft portion 3241 may substantially prevent leakage of cooling water.

The head portion 3242 may protrude from an end portion of the shaft portion 3241. The head portion 3242 may have an outer diameter larger than a diameter of the shaft portion 3241. The head portion 3242 may be caught by an end portion of any one of the cooling water drain valve 3220 and the protruding drain flow channel 3206. Referring to FIG. 8, the head portion 3242 may be caught by an end portion of the protruding drain flow channel 3206. Since the head portion 3242 is caught by the end portion of the protruding drain flow channel 3206, the seal 3240 may be limited in movement. Thus, during a process in which the second housing 3221*b* is inserted into the seal 3240, a position of the seal 3240 may be continuously maintained. The head portion 3242 may prevent the seal 3240 from being pushed.

Before a foam insulator 3210 is formed, a circumferential portion of the head portion 3242 may be exposed between the second housing 3221*b* and the protruding drain flow channel 3206. Since the head portion 3242 is visible from an outside, whether sealing is properly performed by the seal 3240 may be checked before a foaming process.

A protrusion 3243 may be formed in at least one of an outer circumferential surface and an inner circumferential surface of the shaft portion 3241. The protrusion 3243 may be formed along a circumference of the outer circumferential surface or the inner circumferential surface. As shown in FIG. 8, the protrusion 3243 may be formed on both the outer circumferential surface and the inner circumferential surface of the shaft portion 3241. The protrusion 3243 may cause friction to restrict pushing of the seal 3240. The shaft portion 3241 may not be sufficiently tightly attached to the second housing 3221*b* or the protruding drain flow channel 3206, and, since the protrusion 3243 protrudes from the shaft portion 3241, the shaft portion 3241 may be tightly attached to the protruding drain flow channel 3206 for sufficient sealing.

The seal 3240 may be not uniform in cross-section thereof, and thus, may not be manufactured through extrusion. The seal 3240 may be manufactured by injection-molding. Injection molding may refer to a method of introducing an injection-molding material to a mold having a shape of a product to be manufactured, and allowing the injection-molding material to be hardened in the mold. Compared with extrusion, injection molding may be complicated for mass production but may advantageously manufacture a product having a non-uniform cross-section.

Figure 9:
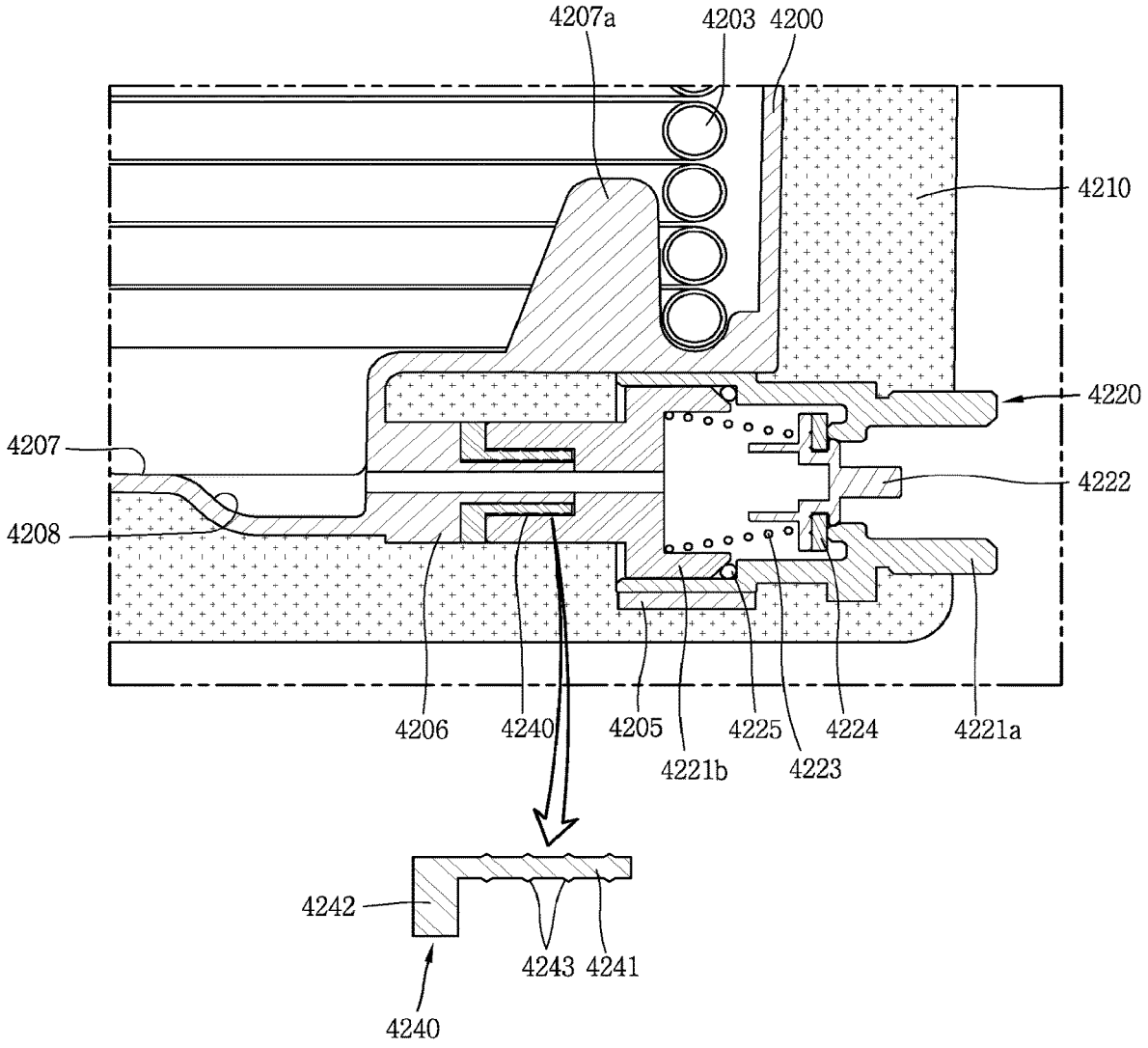
FIG. 9 is a cross-sectional view of a coupling structure of a cold water tank assembly and a cooling water drain valve according to an embodiment.

FIG. 9 is a cross-sectional view of another embodiment regarding a coupling structure of a cold water tank assembly 4200 and a cooling water drain valve 4220. A second housing 4221*b* may be formed to accommodate a protruding drain flow channel 4206. The protruding drain flow channel 4206 may be inserted into a hollow portion of the second housing 4221*b*. A seal 4240 may be inserted between the second housing 4221*b* and the protruding drain flow channel 4206. A direction in which a head portion 4242 of the seal 4240 may be provided may be in an opposite direction of the seal 4240 of the embodiment described above with reference to FIG. 8. Other structures of the cooling water drain valve 4220 may be the same as those described above, so a repeated description thereof has been omitted.

According to embodiments described above, since the foam insulator insulating the cold water tank assembly surrounds even the cooling water drain valve, as well as the cold water tank assembly, the cooling water drain valve may be blocked from being in contact with air. Since the cooling water drain valve is blocked from being in contact with air, dew formation on the cooling water drain valve may be prevented.

The mechanical cooling water drain valve may be provided to cover the cooling water drain valve with a foam insulator. Since the mechanical cooling water drain valve is safe from being broken down even though it may be exposed to water, the mechanical cooling water drain valve may be provided to be adjacent to the cold water tank assembly. The mechanical cooling water drain valve may be covered by a foam insulator together with the cold water tank assembly. Since the cooling water drain valve is provided to be adjacent to the cold water tank assembly, the need for a pipe that may cause formation of dew may be eliminated.

Structures for connection and sealing of the cold water tank assembly and the cooling water drain valve may be provided. A foaming process to form a foam insulator may be based upon a premise that the cold water tank assembly and the cooling water drain valve are sealed. The sealing and foaming processes of the cold water tank assembly and the cooling water drain valve may be performed by differentiating structures of the seal according to various embodiments, and formation of dew on the cooling water drain valve may be prevented.

Embodiments disclosed herein may provide an auxiliary structure to cover both the cold water tank assembly and the cooling water drain valve with a foam insulator. The holder may fix the cooling water drain assembly even after the foaming process, as well as during the foaming process. The barrier may prevent flooding of a bubble solution to form a normal foam insulator. The air gap may also insulate the cold water tank assembly. In addition, a structure in which the cooling water drain valve is not exposed to the air gap may be provided to prevent formation of dew on the cooling water drain valve. Smooth draining may be implemented through the sloped surface formed on the bottom of the cold water tank assembly and the anti-pooling portion.

Embodiments disclosed herein may provide a water dispenser having a structure capable of sufficiently insulating a cooling water drain valve to prevent formation of dew on the cooling water drain valve. A water dispenser may have a structure capable of discharging cooling water without a pipe that may cause formation of dew.

Embodiments disclosed herein may provide a structure to seal a cold water tank assembly forming cold water by storing cooling water and a cooling water drain valve for draining cooling water. In order to sufficiently insulate the cooling water drain valve, sealing of the cold water assembly and the cooling water drain valve may be needed, and thus, the sealing structure may be required for preventing formation of dew. Embodiments disclosed herein may provide a structure to cover both a cold water tank assembly and a cooling water drain valve, a structure to form a foam insulator to prevent formation of dew, and a structure to smoothly drain cooling water.

According to embodiments disclosed herein, may include a water tank to store water, a cooling module provided in the water tank to circulate cooling water to cool the water to make cold water, a drain valve that connects to the water tank and protrudes from the water tank to discharge the cooling water in the water tank, and a foam insulator that covers an outer circumferential surface of the water tank and contacts the drain valve to prevent the drain valve from being exposed to air.

The drain valve may include a housing covered by the foam insulator and having a hollow portion, the hollow portion having a downstream side stop protrusion and an upstream side step, a pressing part having a first portion provided to be caught by the stop protrusion and a second portion that is pressed to open and close the drain valve, and an elastic member that provides an elastic force to tightly attach the first portion of the pressing part to the stop protrusion, the elastic member being supported by the step.

The drain valve may include an O-ring that seals a space between the stop protrusion and the pressing part, the O-ring being coupled to an outer circumferential surface of the pressing part and pressed by the first portion so as to be tightly attached to the stop protrusion.

The water tank may include a protruding drain flow channel connected to the drain valve, any one of the drain valve and the protruding drain flow channel is inserted into the other, and the water dispenser may further include a seal to cover a connection portion between the drain valve and the protruding drain flow channel. The foam insulator may cover the seal.

The water tank may include a protruding drain flow channel connected to the drain valve, any one of the drain valve and the protruding drain flow channel is inserted into the other, and the water dispenser may be installed between the drain valve and the protruding drain flow channel.

The seal may include an annular shaft portion inserted between the drain valve and the protruding drain flow channel, an annular head portion that protrudes from an outer circumferential surface of the shaft portion to have an outer diameter larger than a diameter of the shaft portion and is caught by an end portion of any one of the drain valve and the protruding drain flow channel, and a protrusion formed on at least one of an outer circumferential surface and an inner circumferential surface of the shaft portion. An outer bottom surface of the water tank may partially cover the protruding drain flow channel in a position spaced from an outer circumferential surface of the protruding drain flow channel.

The water tank may include a holder to fix a position of the drain valve, the holder protruding from the outer bottom surface of the water tank and covering the drain valve together with the outer bottom surface in a position where the connection portion between the protruding drain flow channel and the drain valve is not covered. The water tank may include a barrier that protrudes along an outer circumferential surface of an upper portion in order to prevent flooding of a bubble solution during a foaming process of the foam insulator.

The water dispenser may further include a cover that forms an outward appearance of the water dispenser and an air gap formed between an outer circumferential surface of the foam insulator and an inner circumferential surface of the cover, wherein an outer circumferential surface of the drain valve may be continuously covered by the foam insulator and the cover. The foam insulator and the cover may each have a hole in a position that corresponds to the drain valve, and the drain valve may be visible to an outside through the holes.

The water dispenser may further include a cover that forms an outward appearance of the water dispenser, an air gap formed between an outer circumferential surface of the foam insulator and an inner circumferential surface of the cover, and a holder configured to cover a lower portion of the water tank and separate the foam insulator and the cover to form an air gap therebetween, wherein an outer circumferential surface of the drain valve may be continuously covered by the foam insulator, the holder, and the cover. The foam insulator, the holder, and the cover may each have a hole in a position that corresponds to the drain valve, and the drain valve may be visible to an outside through the holes.

An inner bottom surface of the water tank may be sloped. The water tank may include an anti-pooling portion that forms the drain flow channel together with the drain valve, the anti-pooling portion being depressed from the internal bottom surface of the water tank to form a bottom surface lower than the inner bottom surface.

According to embodiments disclosed herein, a water dispenser may include a water tank to store water, a cooling module provided in the water tank to circulate cooling water to cool the water to make cold water, a protruding drain flow channel that protrudes from a lower portion of the water tank, a drain valve connected to the protruding drain flow channel to discharge the cooling water in the water tank, a seal that covers a connection portion between the drain valve and the protruding drain flow channel, and a foam insulator that covers an outer circumferential surface of the water tank, the protruding drain flow channel, the seal, and the drain valve, the foam insulator closely contacting the drain valve to prevent the drain valve from being exposed to air.

The seal may have a hollow cylindrical shape, and the protruding drain flow channel and the drain valve may be inserted in the seal. The seal may include an annular shaft portion inserted between the drain valve and the protruding drain flow channel, an annular head portion that protrudes from an outer circumferential surface of the shaft portion to have an outer diameter larger than a diameter of the shaft portion and is caught by an end portion of any one of the drain valve and the protruding drain flow channel, and a protrusion formed on at least one of an outer circumferential surface and an inner circumferential surface of the shaft portion. The water tank may include a holder that protrudes from a lower portion of the water tank.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid dispenser, comprising:

a water tank configured to store cooling water therein;

a water tank cover configured to cover an opened upper end of the water tank;

a cooling module provided in the water tank to circulate refrigerant therethrough to cool the cooling water;

a motor installed at the water tank cover and configured to provide a rotational force;

an agitator connected to the motor to receive the rotational force from the motor and protruding downward from the motor to be immersed in the cooling water filled in the water tank;

a cooling coil through which drinkable water flows; and a cooling module supporter installed in the water tank, wherein the cooling module includes a coil-shaped refrigerant tube surrounding the agitator at a position spaced apart from the agitator, wherein the cooling coil is configured to surround the agitator at a position spaced apart from the agitator, and is immersed in the cooling water filled in the water tank to allow the drinkable water passing through the cooling coil to be cooled, and wherein the cooling module supporter comprises:

an upper groove formed to support a lower end of the cooling module; and a lower groove mounted on the cooling coil.

2. The liquid dispenser of claim 1, wherein the agitator is protruded to a position lower than the lower end of the cooling module.

3. The liquid dispenser of claim 1, wherein the cooling module supporter includes upper protrusions formed to prevent the cooling module from being released from a normal position, and the upper protrusions are formed on an inner side of the upper groove and an outer side of the upper groove in a radial direction.

4. The liquid dispenser of claim 1, wherein a step portion is formed on an inner circumferential surface of the water tank along a circumferential direction thereof, and an edge of the cooling module supporter is mounted on the step portion.

5. The liquid dispenser of claim 1, wherein the cooling coil is disposed at an opposite side of the cooling module with respect to the cooling module supporter in a vertical direction.

6. The liquid dispenser of claim 1, wherein the cooling module supporter includes lower protrusion formed to prevent the cooling coil from being released from a normal position, and the lower protrusions are formed on an inner side of the lower groove and an outer side of the lower groove in a radial direction.

7. The liquid dispenser of claim 6, wherein an edge of the cooling module supporter is further protruded in the radial direction than a lower protrusion formed on the outer side of the lower groove.

8. The liquid dispenser of claim 6, further comprising a cooling coil supporter, wherein the cooling coil supporter is protruded upward from an inner bottom surface of the water tank, and includes a groove formed to support a lower end of the cooling coil, and the cooling coil is fixed by the cooling module supporter and the cooling coil supporter in the vertical direction.

9. The liquid dispenser of claim 1, further comprising:

a discharge flow channel that discharges the cooling water in the water tank;

a drain valve that connects to the water tank and protrudes from the water tank to discharge the stored cooling water of the water tank, the drain valve forming a furthest downstream part of the discharge flow channel; and a foam insulator that covers an outer circumferential surface of the water tank and contacts the drain valve to prevent the drain valve from being exposed to air, wherein the drain valve is configured to maintain a closed state during a normal operation of the liquid dispenser, and the drain valve is configured to be opened by a physical external force only when discharging of the water in the water tank is required, wherein the water tank includes:

a protruding drain flow channel connected to the drain valve; and a holder that protrudes from an outer bottom surface of the water tank and forms an annular shape to fix the drain valve in a position, the holder covering a portion of the drain valve to expose a connection portion between the drain valve and the protruding drain flow channel, and wherein the foam insulator covers the holder.

10. The liquid dispenser of claim 1, wherein the agitator is protruded to a position lower than an upper end of the cooling coil.

11. The liquid dispenser of claim 1, wherein the lower groove is formed at a position corresponding to the upper groove in the vertical direction.

* * * * *